US008951040B2

(12) United States Patent
Rasi

(10) Patent No.: US 8,951,040 B2
(45) Date of Patent: Feb. 10, 2015

(54) VERTICAL FLAME BURNER

(75) Inventor: Fabio Rasi, Forli (IT)

(73) Assignee: Electrolux Home Products Corporation N.V., Brussels (BE)

( * ) Notice: Subject to any disclaimer, the term of this patent is extended or adjusted under 35 U.S.C. 154(b) by 637 days.

(21) Appl. No.: 13/263,164

(22) PCT Filed: Apr. 27, 2010

(86) PCT No.: PCT/EP2010/002560

§ 371 (c)(1),
(2), (4) Date: Dec. 9, 2011

(87) PCT Pub. No.: WO2010/124834

PCT Pub. Date: Nov. 4, 2010

(65) Prior Publication Data

US 2012/0070792 A1 Mar. 22, 2012

(30) Foreign Application Priority Data

Apr. 30, 2009 (EP) ..... 09005961

(51) Int. Cl.
*F23D 14/04* (2006.01)
*F23D 14/08* (2006.01)

(52) U.S. Cl.
CPC ..... *F23D 14/08* (2013.01)
USPC ..... 431/355; 431/354; 431/144; 126/39 E

(58) Field of Classification Search
USPC ..... 431/355, 144, 354, 328, 326; 126/39 E
See application file for complete search history.

(56) References Cited

U.S. PATENT DOCUMENTS 8,402,962 B2 * 3/2013 Kim et al. ..... 126/39 E

FOREIGN PATENT DOCUMENTS

| | | |
|---|---|---|
| EP | 1528325 | 5/2005 |
| EP | 1898153 | 3/2008 |
| WO | 9318342 | 9/1993 |
| WO | 03062705 | 7/2003 |
| WO | 2007036772 | 4/2007 |

OTHER PUBLICATIONS

International Search Report for PCT/EP2010/002560, dated Jun. 10, 2010, 3 pages.

* cited by examiner

*Primary Examiner* — Alfred Basichas
(74) *Attorney, Agent, or Firm* — Pearne & Gordon LLP

(57) ABSTRACT

A gas burner (10) comprising a bowl-shaped base body (12), a burner crown (14) arranged on the base body (12) and an upper cap (16) arranged on the burner crown (14), wherein a plurality of flame ports (34) is provided to let out a gas-air mixture towards to a recipient (36) to be heated, wherein the flame ports (34) are formed in such a manner that the gas-air mixture leaves the flame ports (34) in an essentially vertical direction.

9 Claims, 1 Drawing Sheet

VERTICAL FLAME BURNER

TECHNICAL FIELD

Figure 1:
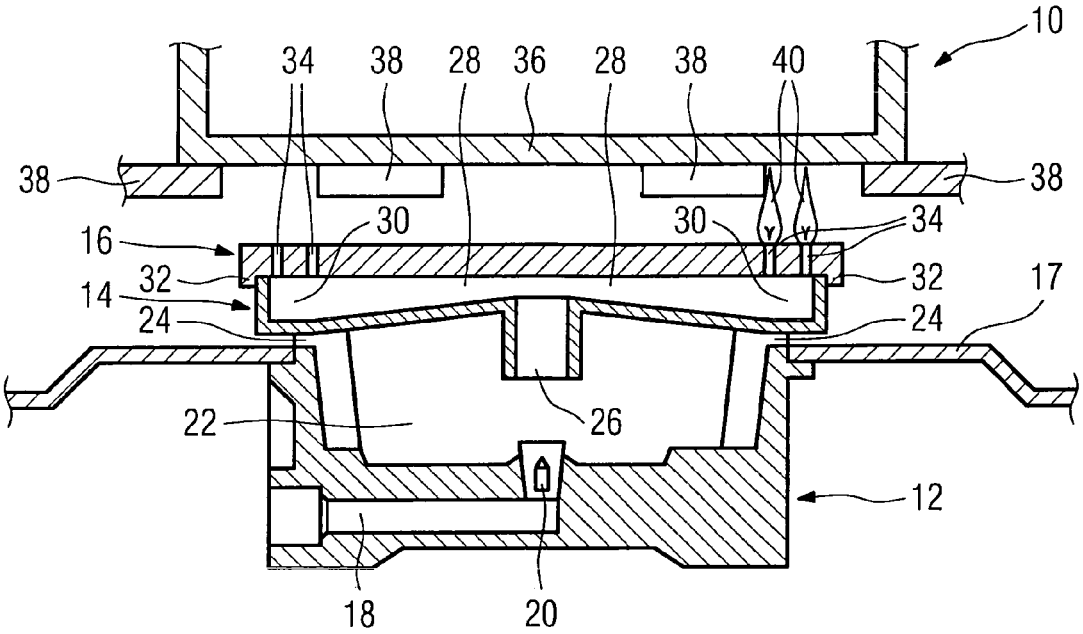

The present invention relates to a gas burner comprising a bowl-shaped base body, a burner crown arranged on a the base body and an upper cap arranged on the burner crown, wherein a plurality of flame port is provided to let out a gas-air mixture towards a recipient to be heated.

A gas burner of the above mentioned a kind is known for example is from EP-A-1512909. This gas burner is substantially formed by a bowl-shaped base body, toothed burner crown arranged on the base body and upper cap. The bowl-shaped base body is associated with an injector through which the gas is supplied. The burner crown is provided on its circumference with a plurality of flame ports to let the gas-air mixture go out in a radial direction and essentially is parallel to the bottom of the recipient to be heated. The upper cap closes the burner top and defines the flame ports together with the burner crown. The size and the number of flame ports can vary in order to let the gas-air mixture leave the gas burner as a desired velocity, pressure and distribution along the burner circumference. One major drawback of such a gas burner construction is that a lot of heat is released to the environment by the flames produced by flame ports of the above mentioned kind. Accordingly, the efficiency of the gas burner is low. Moreover, the heat released to the environment may negatively effect the life time or the appearance of components arranged within a spitting distance, e.g. the color of the working plate of the domestic cooking appliance, to which the gas burner is fixed, or the like.

It is an object of the present invention to provide a gas burner of the above mentioned kind with a good efficiency. Moreover, it is an object of the present invention to provide a gas burner of the above mentioned kind whose flames do not negatively effect the life time or the appearance of other components.

In order to solve this object the present invention provides a gas burner of the above mentioned kind, whose flame ports are formed in such a manner that the gas-air mixture leaves the flame ports in an essentially vertical direction and this essentially perpendicular the bottom of the recipient to be heated. Accordingly, only very few heat is released to the environment such that now derogations of the life time or the appearance of the components are to be expected. Moreover, deal to the little heat of the burner is high.

According to one embodiment of the present invention flame ports are formed by through holes in particular bores, extending through the upper cap in an essentially vertical direction.

Preferably, the flame ports are arranged in at least one row along the perimeter of the upper cap.

According to one embodiment of the present invention the burner crown is provided with at least one venturi pipe for feeding the gas-air mixture into the burner crown.

The burner crown is preferably provided with a mixing zone for mixing the gas-air mixture fed into the burner crown, wherein the mixing zone is advantageously formed as an annular chamber whose cross section incrementally expense towards the flame ports.

Moreover, the burner crown is preferably provided with a steady zone having a continuous perimeter section being formed between the mixing zone and the flame ports. Accordingly the gas-air mixture is fed to the flame ports at the same pressure and the same velocity.

Moreover, the present invention provides domestic cooking appliance comprising again the burner of the kind defined above.

The detail configuration, features and advantageous of the present invention will become apparent in the course of the following description with reference to the accompanying drawings.

Figure 2:
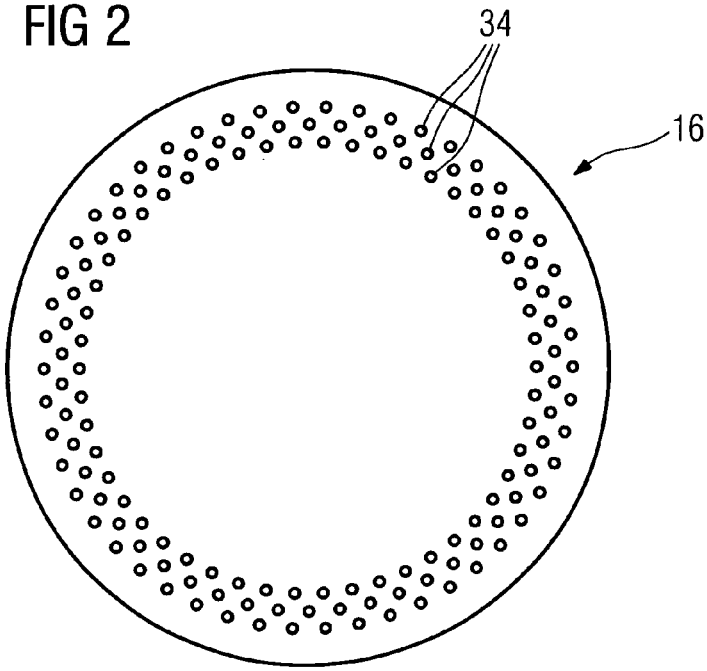

FIG. 1 is a schematical cross sectional view of a gas burner according to an embodiment of the present invention; and FIG. 2 is a schematical top view of an upper cap of the gas burner shown in FIG. 1.

The gas burner 10 according to an embodiment of the present invention comprises a bowl-shaped base body 12, a burner crown 14 arranged on the base body 12 and an upper cap 16 arranged on the burner crown 14.

The base body 12 of the gas burner 10 is received in a working plate 17 of the domestic cooking appliance (not shown in further detail) and comprises in its lower portion a gas supplying pipe 18 and an injector 20, which is connected to the gas supplying pipe 18. The injector 20 projects into a first chamber 22, which is provided with several inlets 24 through which ambient air is supplied into this chamber 22.

The burner crown 14, which is arranged on top of the bowl-shaped base body 12, comprises a venturi pipe 26, which projects into and/or leads into the first chamber 22 and/or a mixing zone 28 and is arranged vertically above the injector 20. The venturi pipe 26 leads into the annular mixing zone 28, which is defined by the burner crown 14 and the upper cap 16 and whose cross section or perimeter section expands radially outwards from the venturi pipe 26. The mixing zone 28 passes into a steady zone 30, which is defined by the burner crown 14 and the upper cap 16 and has a constant cross section or perimeter section in the radial direction.

The upper cap 16 is provided at its lower circumferential edge with an annular projection 32, which encompasses the burner crown 14 such that the upper cap is stationary fixed thereon. Moreover, the upper cap 16 is provided with a plurality of flame ports 34 within the region above the steady zone 30. The flame ports 34 are provided in the form of through holes, in particular bores, extending through the upper cap 16 in an essentially vertical direction. The flame ports 34 are arranged along the perimeter of the upper cap 14. A recipient 36 to be heated by the gas burner 10 is arranged above the upper cap 16 and is supported by a supporting structure 38, which is not shown in further detail.

During the operation of the gas burner 10 the gas is supplied to the injector 20 through the gas supplying pipe 18. The injector 20 injects the gas into the mixing zone 28. Within the chamber 22 the ambient air is sucked through the inlets 24 and then flows through the venturi pipe 26 into the mixing zone 28 of the burner crown 14 where the gas-air mixture is mixed. Due to the incrementally extending cross section of the mixing zone 28, the pressure and the velocity of the gas-air mixture are reduced until the gas-air mixture reaches the steady zone 30. Within the steady zone 30 the pressure and the velocity of the gas-air mixture are kept constant in order to distribute the mixture evenly across the flame ports 34. The gas-air mixture leaves the gas burner 10 through the flame ports 34 in an essentially vertical direction, i.e. perpendicular to the bottom of the recipient 36 to be heated, and is ignited directly after leaving the upper cap 16. Accordingly, essentially vertical extending flames 40 are created.

Due to the fact that the flames 40 extend essentially perpendicular to the bottom of the recipient 36 to be heated, most of the heat is transferred to the recipient 36. Thus, the efficiency of the gas burner 10 is very high. Moreover, only very few heat is released into the environment. Accordingly, no damage of other components, such as a derogation of the color of the working plate 17 of the domestic cooking appliance, is to be expected.

The invention claimed is:

1. A gas burner (10) comprising a bowl-shaped base body (12), a burner crown (14) arranged on the base body (12) and an upper cap (16) arranged on the burner crown (14), wherein a plurality of flame ports (34) is provided to let out a gas-air mixture towards to a recipient (36) to be heated, wherein the burner crown (14) is provided with a mixing zone (28) for mixing the gas-air mixture fed into the burner crown (14), and wherein the mixing zone (28) is formed as an annular chamber whose cross section incrementally expands away from the upper cap (16) to define a steady zone (30), the steady zone (30) having a continuous perimeter section in a radial direction and being formed below the flame ports (34), wherein the steady zone is configured to distribute the gas-air mixture to the flame ports (34) in such a manner that the gas-air mixture leaves the flame ports (34) in an essentially vertical direction.

2. Gas burner (10) according to claim 1, characterized in that the flame ports (34) are formed by through holes, in particular bores, extending through the upper cap (16) in an essentially vertical direction.

3. Gas burner (10) according to claim 2, characterized in that the flame ports (34) are arranged in at least one row along the perimeter of the upper cap (16).

4. Gas burner (10) according to claim 1, characterized in that the burner crown (14) is provided with a venturi pipe (26) for feeding the gas-air mixture.

5. Gas burner (10) according to claim 1, characterized in that the distance between the burner cap (16) and the base of the burner crown (14) in the steady zone (30) is greater than the distance between the burner cap (16) and the base of the burner crown (14) in the mixing zone (28).

6. A cooking appliance, the cooking appliance comprising a gas burner (10) having a bowl-shaped base body (12), a burner crown (14) arranged on the base body (12) and an upper cap (16) arranged on the burner crown (14), wherein a plurality of flame ports (34) is provided to let out a gas-air mixture towards to a recipient (36) to be heated, wherein the burner crown (14) is provided with a mixing zone (28) for mixing the gas-air mixture fed into the burner crown (14), and wherein the mixing zone (28) is formed as an annular chamber, whose cross section incrementally extends away from the flame ports and terminates at a steady zone (30), the steady zone (30) having a continuous perimeter section and being formed adjacent to the mixing zone (28) and underneath the flame ports (34), wherein the flame ports (34) are formed in such a manner that the gas-air mixture leaves the flame ports (34) in an essentially vertical direction.

7. A cooking appliance according to claim 6, characterized in that the flame ports (34) are formed by through holes, in particular bores, extending through the upper cap (16) in an essentially vertical direction.

8. A cooking appliance according to claim 6, characterized in that the gas burner (10) further includes an inlet (24) arranged above a working plate (17) of the cooking appliance, wherein the inlet (24) is configured to suck ambient air into the gas burner.

9. A gas burner (10) comprising a bowl-shaped base body (12), a burner crown (14) arranged on the base body (12) and an upper cap (16) arranged on the burner crown (14), wherein a plurality of flame ports (34) is provided to let out a gas-air mixture towards to a recipient (36) to be heated, wherein the burner crown (14) is provided with a mixing zone (28) for mixing the gas-air mixture fed into the burner crown (14), and wherein the mixing zone (28) is formed as an annular chamber whose cross section expands radially outward away from a center of the burner crown (14) and passes into in a steady zone (30) defined by the burner crown 14 and the upper cap 16, the steady zone (30) having a continuous perimeter section in a radial direction, wherein the steady zone is configured to distribute the gas-air mixture to the flame ports (34) in such a manner that the gas-air mixture leaves the flame ports (34) in an essentially vertical direction.

* * * * *